US010907234B2

(12) United States Patent
Fujimura et al.

(10) Patent No.: US 10,907,234 B2
(45) Date of Patent: Feb. 2, 2021

(54) GRAIN-ORIENTED ELECTRICAL STEEL SHEET AND DECARBURIZED STEEL SHEET USED FOR MANUFACTURING THE SAME

(71) Applicant: NIPPON STEEL & SUMITOMO METAL CORPORATION, Tokyo (JP)

(72) Inventors: Hiroshi Fujimura, Tokyo (JP); Fumiaki Takahashi, Tokyo (JP); Takashi Kataoka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 306 days.

(21) Appl. No.: 15/768,696

(22) PCT Filed: Oct. 26, 2016

(86) PCT No.: PCT/JP2016/081732

§ 371 (c)(1),
(2) Date: Apr. 16, 2018

(87) PCT Pub. No.: WO2017/073615

PCT Pub. Date: May 4, 2017

(65) Prior Publication Data

US 2018/0305784 A1 Oct. 25, 2018

(30) Foreign Application Priority Data

Oct. 26, 2015 (JP) ..... 2015-209663

(51) Int. Cl.

| | |
|---|---|
| ***C21D 9/46*** | (2006.01) |
| ***C22C 38/16*** | (2006.01) |
| ***H01F 1/18*** | (2006.01) |
| ***C21D 8/12*** | (2006.01) |
| ***C22C 38/60*** | (2006.01) |

(Continued)

(52) U.S. Cl.

CPC ..... *C21D 9/46* (2013.01); *C21D 3/04* (2013.01); *C21D 6/008* (2013.01); *C21D 8/005* (2013.01);

(Continued)

(58) Field of Classification Search

CPC ..... C22C 38/00; C21D 8/1222

See application file for complete search history.

(56) References Cited

U.S. PATENT DOCUMENTS

| | | | | |
|---|---|---|---|---|
| 2009/0047537 | A1 | 2/2009 | Nanba et al. | |
| 2015/0170812 | A1* | 6/2015 | Murakami | C22C 38/00 148/111 |
| 2020/0063234 | A1* | 2/2020 | Suehiro | C21D 8/1222 |

FOREIGN PATENT DOCUMENTS

| | | | |
|---|---|---|---|
| EP | 0 957 180 | A2 | 11/1999 |
| EP | 2 775 007 | A1 | 9/2014 |

(Continued)

OTHER PUBLICATIONS

Extended European Search Report for European Application No. 16859844.9, dated Jun. 7, 2019.

(Continued)

*Primary Examiner* — Scott R Kastler

(74) *Attorney, Agent, or Firm* — Birch, Stewart, Kolasch & Birch, LLP

(57) ABSTRACT

A grain-oriented electrical steel sheet includes: a chemical composition represented by, in mass %, Si: 1.8% to 7.0%, Cu: 0.03% to 0.60%, and the balance: Fe and impurities; and a primary coating film containing forsterite on a surface of the steel sheet, in which a Cu/Fe light-emitting intensity ratio at an interface region between the primary coating film and the surface of the steel sheet is 0.30 or less.

5 Claims, 3 Drawing Sheets

(51) Int. Cl.

| | |
|---|---|
| ***H01F 1/16*** | (2006.01) |
| ***C21D 3/04*** | (2006.01) |
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C23G 1/08*** | (2006.01) |

(52) U.S. Cl.

CPC ..... *C21D 8/12* (2013.01); *C21D 8/1222* (2013.01); *C21D 8/1233* (2013.01); *C21D 8/1255* (2013.01); *C21D 8/1261* (2013.01); *C21D 8/1283* (2013.01); *C22C 38/001* (2013.01); *C22C 38/002* (2013.01); *C22C 38/008* (2013.01); *C22C 38/02* (2013.01); *C22C 38/04* (2013.01); *C22C 38/16* (2013.01); *C22C 38/60* (2013.01); *C23G 1/085* (2013.01); *H01F 1/16* (2013.01); *H01F 1/18* (2013.01)

(56) References Cited

FOREIGN PATENT DOCUMENTS

| | | | |
|---|---|---|---|
| JP | 6-88171 | A | 3/1994 |
| JP | 7-48674 | A | 2/1995 |
| JP | 8-269552 | A | 10/1996 |
| JP | 8-277421 | A | 10/1996 |
| JP | 9-268322 | A | 10/1997 |
| JP | 10-8133 | A | 1/1998 |
| JP | 10-102149 | A | 4/1998 |
| JP | 2003-193141 | A | 7/2003 |
| JP | 2005-290446 | A | 10/2005 |
| JP | 2008-127634 | A | 6/2008 |
| JP | 2011-68968 | A | 4/2011 |
| JP | 2011-111645 | A | 6/2011 |
| JP | 2012-214902 | A | 11/2012 |
| JP | 2014-196559 | A | 10/2014 |

OTHER PUBLICATIONS

International Preliminary Report on Patentability and English translation of the Written Opinion of the International Searching Authority (forms PCT/IB/373, PCT/ISA/237 and PCT/IB/338), dated May 11, 2018, for corresponding International Application No. PCT/JP2016/081732.

International Search Report for PCT/JP2016/081732 dated Jan. 31, 2017.

Written Opinion of the International Searching Authority for PCT/JP2016/081732 (PCT/ISA/237) dated Jan. 31, 2017.

* cited by examiner

GRAIN-ORIENTED ELECTRICAL STEEL SHEET AND DECARBURIZED STEEL SHEET USED FOR MANUFACTURING THE SAME

TECHNICAL FIELD

The present invention relates to a grain-oriented electrical steel sheet and a decarburized steel sheet used for manufacturing the same.

BACKGROUND ART

A grain-oriented electrical steel sheet used for an iron core material of, for example, a transformer and the like is a steel sheet that contains Si of 1.8 mass % to 7 mass % or so and in which crystal grain orientations of a product are highly accumulated in the {110}<001> orientation. The control of these crystal orientations is achieved by utilizing a catastrophic grain growth phenomenon called secondary recrystallization. As a typical method for controlling this secondary recrystallization, there is a method in which a steel billet is heated to a high temperature of 1280° C. or more before hot rolling to once solid-dissolve precipitates such as AlN, and in a hot rolling step and a subsequent annealing step, they are made to precipitate again as fine precipitates called inhibitors. Although a lot of developments have been made in order to obtain a steel sheet having a more excellent magnetic property in the manufacture of such a grain-oriented electrical steel sheet, achievement of much lower core loss has been required as a demand for recent energy-saving further increases. Although there are various methods for achieving low core loss of the grain-oriented electrical steel sheet, a method of increasing a magnetic flux density to reduce a hysteresis loss is effective. For improving the magnetic flux density of the grain-oriented electrical steel sheet, it is important to highly accumulate crystal grain orientations of a product in the {110}<001> orientation. In order to highly accumulate the crystal grain orientations of a product in the {110}<001> orientation, various techniques regarding the grain-oriented electrical steel sheet and a chemical composition of a slab used for its manufacture have been proposed.

In the meantime, at the final stage in the manufacture of the grain-oriented electrical steel sheet, the steel sheet has an annealing separating agent containing MgO as its main component applied thereto to be dried and is coiled into a coil, and then is subjected to final finish annealing. On this occasion, due to a reaction between MgO and a coating film mainly composed of $SiO_2$ that is formed in decarburization annealing, a primary coating film containing forsterite ($Mg_2SiO_4$) as its main component is formed on the surface of the steel sheet. Thus, for utilizing such a method of improving the magnetic flux density as described above on an industrial scale, in addition to the magnetic property being good, it is important for adhesion of the primary coating film to be good stably.

Although various techniques have been proposed so far, it is difficult to achieve both a good magnetic property and excellent adhesion between the primary coating film and the steel sheet.

CITATION LIST

Patent Literature

Patent Literature 1: Japanese Laid-open Patent Publication No. 06-88171

Patent Literature 2: Japanese Laid-open Patent Publication No. 08-269552

Patent Literature 3: Japanese Laid-open Patent Publication No. 2005-290446

Patent Literature 4: Japanese Laid-open Patent Publication No. 2008-127634

Patent Literature 5: Japanese Laid-open Patent Publication No. 2012-214902

Patent Literature 6: Japanese Laid-open Patent Publication No. 2011-68968

Patent Literature 7: Japanese Laid-open Patent Publication No. 10-8133

Patent Literature 8: Japanese Laid-open Patent Publication No. 07-48674

SUMMARY OF INVENTION

Technical Problem

An object of the present invention is to provide a grain-oriented electrical steel sheet having a good magnetic property and having excellent adhesion between a primary coating film and the steel sheet and a decarburized steel sheet used for manufacturing the same.

Solution to Problem

The present inventors conducted earnest examinations in order to solve the above-described problems. As a result of the earnest examination, it became clear that in the case where Cu and a specific element such as Bi are contained in the steel sheet, it is possible to obtain an excellent magnetic property, but it is not possible to obtain sufficient adhesion of the primary coating film. Then, the present inventors further conducted earnest examinations of the effect of Cu on the adhesion of the primary coating film. As a result, they found out that the steel sheet containing the above-described specific element and Cu and having good adhesion with the primary coating film correlates with the Cu concentration at an interface region between the primary coating film and the steel sheet.

As a result of further repeated earnest examinations based on such findings, the present inventors have reached the following various aspects of the invention.

(1)

A grain-oriented electrical steel sheet, includes:

a chemical composition represented by in mass %,

Si: 1.8% to 7.0%,

Cu: 0.03% to 0.60%, and the balance: Fe and impurities; and a primary coating film containing forsterite on a surface of the steel sheet, in which a Cu/Fe light-emitting intensity ratio at an interface region between the primary coating film and the surface of the steel sheet is 0.30 or less.

(2)

A decarburized steel sheet for a grain-oriented electrical steel sheet, includes:

a chemical composition represented by, in mass %,

C: 0.03% to 0.15%,

Si: 1.8% to 7.0%,

Mn: 0.02% to 0.30%,

S: 0.005% to 0.040%, acid-soluble Al: 0.010% to 0.065%,

N: 0.0030% to 0.0150%,

Cu: 0.03% to 0.60%,

Sn: 0% to 0.5%,

Ge, Se, Sb, Te, Pb, or Bi, or an arbitrary combination of these: 0.0005% to 0.030% in total, and the balance: Fe and impurities; and an oxide film on a surface of the steel sheet, in which a Cu/Fe light-emitting intensity ratio at an interface region between the oxide film and the surface of the steel sheet is 0.60 or less.

(3)

A manufacturing method of a grain-oriented electrical steel sheet, includes:

a step of heating a slab in a temperature zone of 1300° C. to 1490° C.;

a step of obtaining a hot-rolled steel sheet by performing hot rolling of the slab;

a step of coiling the hot-rolled steel sheet in a temperature zone of 600° C. or less;

a step of performing hot-rolled sheet annealing of the hot-rolled steel sheet;

after the hot-rolled sheet annealing, a step of performing cold rolling and obtaining a cold-rolled steel sheet;

a step of performing decarburization annealing of the cold-rolled steel sheet; and after the decarburization annealing, a step of applying an annealing separating agent containing MgO and performing finish annealing, in which the step of performing the hot rolling includes a step of performing rough rolling with a finishing temperature set to 1200° C. or less and a step of performing finish rolling with a start temperature set to 1000° C. or more and a finishing temperature set to 950° C. to 1100° C., in the hot rolling, the finish rolling is started within 300 seconds after start of the rough rolling, cooling at a cooling rate of 50° C./second or more is started within 10 seconds after finish of the finish rolling, pickling with a holding temperature set to 50° C. or more and a holding time period set to 30 seconds or more is performed in a pickling bath containing a nitric acid, a pickling inhibitor, and a surface active agent after the hot rolling and before finish of the cold rolling, and the slab includes a chemical composition represented by, in mass %, C: 0.03% to 0.15%, Si: 1.8% to 7.0%, Mn: 0.02% to 0.30%, S: 0.005% to 0.040%, acid-soluble Al: 0.010% to 0.065%, N: 0.0030% to 0.0150%, Cu: 0.03% to 0.60%, Sn: 0% to 0.5%, Ge, Se, Sb, Te, Pb, or Bi, or an arbitrary combination of these: 0.0005% to 0.030% in total, and the balance: Fe and impurities.

(4)

The manufacturing method of the grain-oriented electrical steel sheet according to (3), in which the pickling bath further contains a nitrate.

(5)

A manufacturing method of a decarburized steel sheet for a grain-oriented electrical steel sheet, includes:

a step of heating a slab in a temperature zone of 1300° C. to 1490° C.;

a step of obtaining a hot-rolled steel sheet by performing hot rolling of the slab;

a step of coiling the hot-rolled steel sheet in a temperature zone of 600° C. or less;

a step of performing hot-rolled sheet annealing of the hot-rolled steel sheet;

after the hot-rolled sheet annealing, a step of performing cold rolling and obtaining a cold-rolled steel sheet; and a step of performing decarburization annealing of the cold-rolled steel sheet; in which the step of performing the hot rolling includes a step of performing rough rolling with a finishing temperature set to 1200° C. or less and a step of performing finish rolling with a start temperature set to 1000° C. or more and a finishing temperature set to 950° C. to 1100° C., in the hot rolling, the finish rolling is started within 300 seconds after start of the rough rolling, cooling at a cooling rate of 50° C./second or more is started within 10 seconds after finish of the finish rolling, pickling with a holding temperature set to 50° C. or more and a holding time period set to 30 seconds or more is performed in a pickling bath containing a nitric acid, a pickling inhibitor, and a surface active agent after the hot rolling and before finish of the cold rolling, and the slab includes a chemical composition represented by, in mass %

C: 0.03% to 0.15%,

Si: 1.8% to 7.0%,

Mn: 0.02% to 0.30%,

S: 0.005% to 0.040%, acid-soluble Al: 0.010% to 0.065%,

N: 0.0030% to 0.0150%,

Cu: 0.03% to 0.60%,

Sn: 0% to 0.5%,

Ge, Se, Sb, Te, Pb, or Bi, or an arbitrary combination of these: 0.0005% to 0.030% in total, and the balance: Fe and impurities.

(6)

The manufacturing method of the decarburized steel sheet for a grain-oriented electrical steel sheet according to (5), in which the pickling bath further contains a nitrate.

Advantageous Effects of Invention

According to the present invention, it is possible to obtain excellent adhesion between a primary coating film and a steel sheet and a good magnetic property because the Cu concentration at an interface region between the primary coating film and the steel sheet is appropriate.

DESCRIPTION OF EMBODIMENTS

Hereinafter, there will be explained embodiments of the present invention in detail.

When manufacturing a grain-oriented electrical steel sheet using a silicon steel material that contains a specific element such as Bi for the purpose of improving a magnetic property, the adhesion between a primary coating film and the steel sheet sometimes deteriorates. Conventionally, it has been known that Cu is contained in a slab when scrap is mixed in a raw material at the time of steelmaking, but mixture of Cu from the scrap has not been a problem in particular as long as it is small in amount because Cu is an element to improve the magnetic property and is not a particularly controversial element with respect to the adhesion of the primary coating film. However, the present inventors found out that in the case of using the silicon steel material containing the above-described specific element, the adhesion of the primary coating film deteriorates even at a level where the Cu content has been considered to be uncontroversial conventionally, a Cu concentrated portion exists on the surface of a steel sheet resulting from decarburization annealing, and this portion causes the deterioration. Then, as a result of further repeated earnest examinations, the present inventors found out that pickling under a conventional treatment condition fails to remove the Cu concentrated portion on the surface of the steel sheet, and in a manufacturing process, the Cu concentrated portion is removed from the surface of the steel sheet by pickling under a predetermined condition, thereby enabling an improvement in the adhesion of the primary coating film. Hereinafter, there will be explained an experiment by which such findings were able to be obtained.

Figure 1:
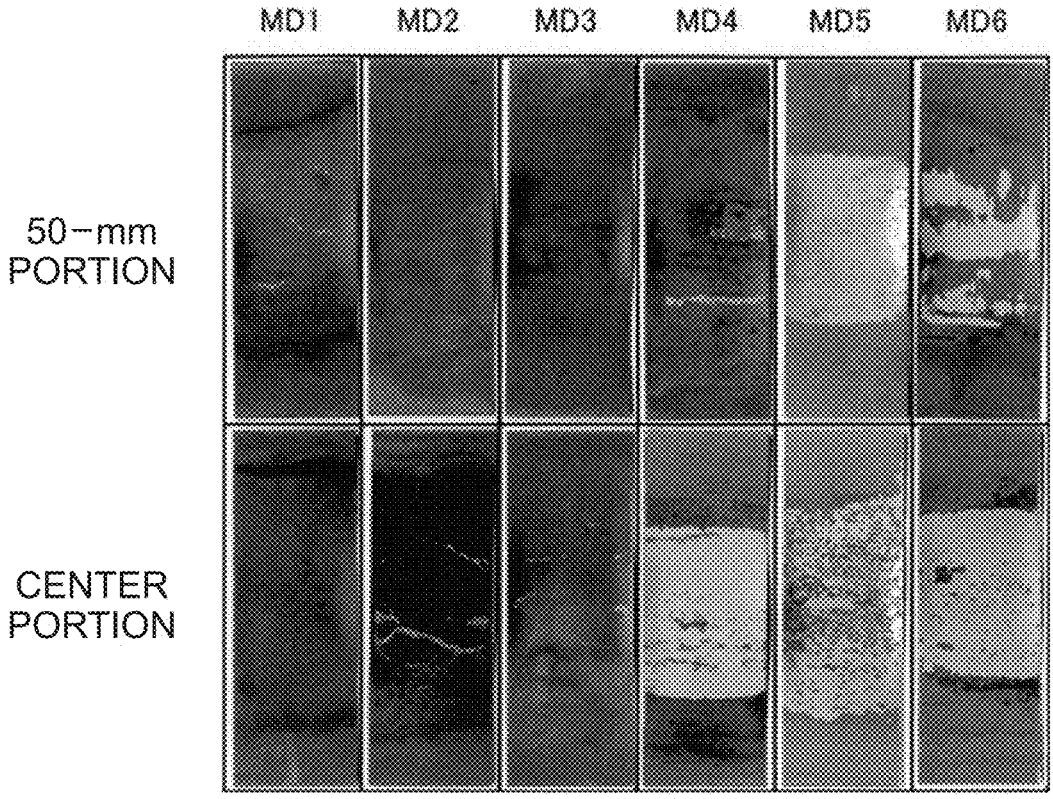
FIG. 1 is images resulting from photographing surfaces of samples that have undergone a bending test.

In a vacuum melting furnace, silicon steel materials having chemical compositions illustrated in Table 1 were fabricated, after being heated at 1350° C., slabs were subjected to hot rolling to obtain hot-rolled steel sheets having a sheet thickness of 2.3 mm, and then they were subjected to hot-rolled sheet annealing and pickling and then subjected to cold rolling, and cold-rolled steel sheets having a sheet thickness of 0.22 mm were obtained. Incidentally, each balance of the silicon steel materials illustrated in Table 1 is Fe and impurities. Then, the cold-rolled steel sheets were subjected to primary recrystallization annealing including decarburization annealing, had an annealing separating agent containing MgO as its main component applied thereto, and then were subjected to finish annealing, and various grain-oriented electrical steel sheets were obtained. The obtained steel sheets had an insulating coating film applied thereto to be baked. Each magnetic flux density $B_8$ (magnetic flux density at a magnetic field intensity of 800 A/m) of the obtained steel sheets was measured. Further, each sample was taken from a portion 50 mm away from the end in a coil width direction in the finish annealing and from a center portion in the coil width direction, and they were subjected to a bending test in which each sample was wound on a 20-mm ϕ cylindrical body. The adhesion of the primary coating film was evaluated from these results. FIG. 1 shows images resulting from photographing surfaces of the samples that have undergone the bending test of the steel sheets manufactured using Steel type MD1 to Steel type MD6. Further, measurement results of the magnetic flux density $B_8$ are illustrated in Table 2. Incidentally, the specific element in Table 1 indicates Ge, Se, Sb, Te, Pb, or Bi, and the steel type with the description of "-" in the space of specific element used no specific element.

TABLE 1

| STEEL TYPE | CHEMICAL COMPOSITION (MASS %) | | | | | | | | | |
|---|---|---|---|---|---|---|---|---|---|---|
| | C | Si | Mn | P | S | Cu | ACID-SOLUBLE Al | Sn | N | SPECIFIC ELEMENT |
| MD1 | 0.08 | 3.3 | 0.04 | 0.008 | 0.025 | <0.005 | 0.028 | 0.10 | 0.0081 | — |
| MD2 | 0.08 | 3.3 | 0.04 | 0.008 | 0.025 | <0.005 | 0.028 | 0.10 | 0.0081 | Bi = 0.005 |
| MD3 | 0.08 | 3.3 | 0.04 | 0.008 | 0.026 | 0.410 | 0.028 | 0.10 | 0.0082 | — |
| MD4 | 0.08 | 3.3 | 0.04 | 0.008 | 0.026 | 0.410 | 0.028 | 0.10 | 0.0083 | Te = 0.005 |
| MD5 | 0.08 | 3.3 | 0.04 | 0.008 | 0.025 | 0.800 | 0.025 | 0.10 | 0.0081 | — |
| MD6 | 0.08 | 3.3 | 0.08 | 0.008 | 0.025 | 0.200 | 0.028 | 0.10 | 0.0080 | Pb = 0.035 |
| MD7 | 0.08 | 3.3 | 0.08 | 0.008 | 0.025 | 0.300 | 0.027 | 0.10 | 0.0080 | Ge = 0.005 |
| MD8 | 0.08 | 3.3 | 0.08 | 0.008 | 0.015 | 0.300 | 0.027 | 0.10 | 0.0080 | Se = 0.015 |
| MD9 | 0.08 | 3.3 | 0.08 | 0.008 | 0.025 | 0.300 | 0.027 | 0.10 | 0.0080 | Sb = 0.025 |
| MD10 | 0.08 | 3.3 | 0.08 | 0.008 | 0.025 | 0.400 | 0.027 | 0.10 | 0.0080 | Pb = 0.006 |

TABLE 2

| STELL TYPE | MAGNETIC FLUX DENSITY $B_8$ (T) |
|---|---|
| MD1 | 1.786 |
| MD2 | 1.925 |
| MD3 | 1.859 |
| MD4 | 1.945 |
| MD5 | 1.920 |
| MD6 | 1.954 |
| MD7 | 1.956 |
| MD8 | 1.949 |
| MD9 | 1.951 |
| MD10 | 1.953 |

Table 2 reveals that in Steel type MD4 and Steel type MD6 to Steel type MD10 each containing a predetermined amount of Cu as well as the specific element, the high magnetic flux density $B_8$ of 1.94 T or more was obtained. In Steel type MD1 and Steel type MD3 not containing the specific element, the low magnetic flux density $B_8$ of 1.90 T or less was obtained. As above, combining Cu and the specific element made it possible to obtain a grain-oriented electrical steel sheet having a high magnetic flux density.

As shown in FIG. 1, in Steel type MD4 and Steel type MD6 to Steel type MD10 each containing the specific element and Cu and in Steel type MD5 with the Cu content being relatively high, the primary coating film was peeled off after bending to expose the steel sheet, resulting in failure of the adhesion. In Steel type MD1 with the Cu content being small and not containing the specific element, in Steel type MD2 with the Cu content being small, and in Steel type MD3 not containing the specific element, the primary coating film was not peeled off even after bending and the adhesion was good. As above, in the case where the grain-oriented electrical steel sheet was manufactured using the slab containing the specific element and Cu, the grain-oriented electrical steel sheet having a high magnetic flux density was obtained, but its adhesion deteriorated.

Next, the reason why the adhesion deteriorated was examined. It has been known in the manufacture of the steel sheet containing Cu that Cu is concentrated in a surface portion of the slab as oxide scales are generated at the time of slab heating before hot rolling. The Cu concentrated portion is extended by hot rolling, but is not dissolved in a hydrochloric acid or sulfuric acid aqueous solution, which is used for a general pickling bath, even in pickling after hot rolling. Therefore, it was considered that the Cu concentrated portion remains on the surface of the steel sheet even after cold rolling to impair the adhesion between the primary coating film and the steel sheet. As a result that in order to confirm this consideration, regarding Steel type MD4, the hot-rolled steel sheets resulting from hot rolling were subjected to pickling under various conditions to fabricate grain-oriented electrical steel sheets and the grain-oriented electrical steel sheets were subjected to the bending test similar to the above, the adhesion between the primary coating film and the steel sheet improved in the case where the pickling was performed under a specific condition.

Figure 2:
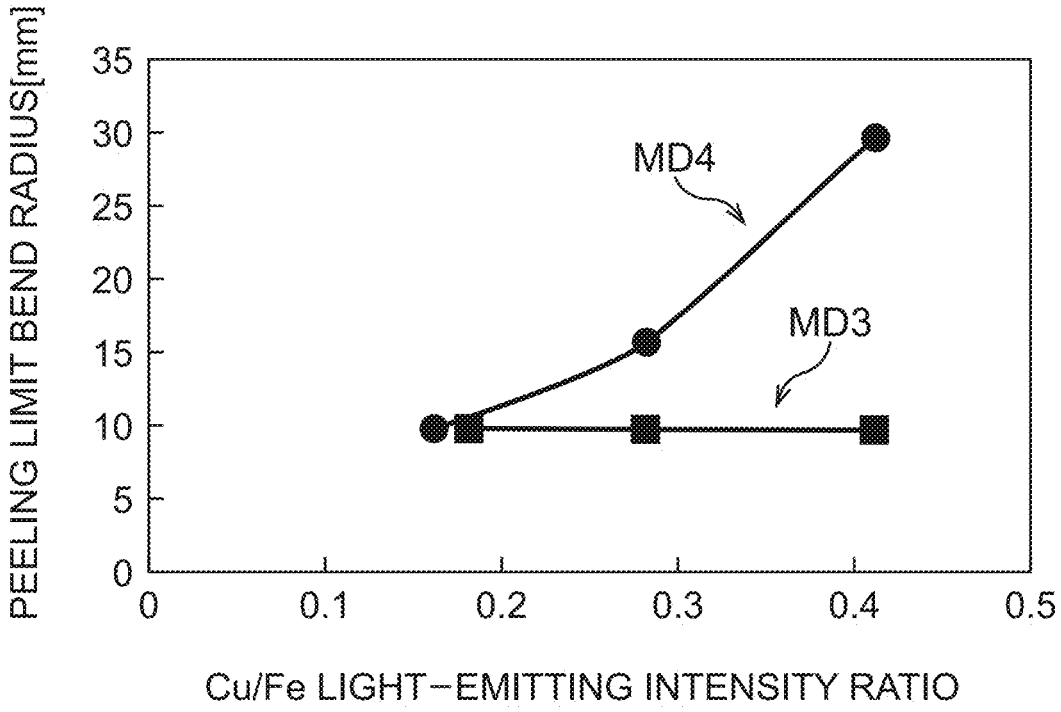
FIG. 2 is a chart illustrating the relationship between a Cu concentration at an interface region between a primary coating film and a steel sheet and a minimum bend radius at which peeling occurs.

Thus, the present inventors examined the effect of the Cu concentration at an interface region between the primary coating film and the steel sheet on the adhesion of the primary coating film. With Steel type MD3 and Steel type MD4, grain-oriented electrical steel sheets with different degrees of removing the Cu concentrated portion on the surface of the steel sheet were fabricated by variously changing the pickling condition after hot rolling, and each Cu concentration at an interface region between the primary coating film and the steel sheet was measured by GDS analysis (glow discharge optical emission spectrometry). Further, they examined the relationship between the Cu concentration at the interface region between the primary coating film and the steel sheet and the minimum bend radius at which peeling occurs while changing the bend radius to 10 mm to 30 mm. The peeling was defined as an area ratio of a peeled portion being 10% or more. Incidentally, a ratio of a Cu light-emitting intensity to an Fe light-emitting intensity in the GDS analysis, namely a Cu/Fe light-emitting intensity ratio was substituted for the Cu concentration. This is because the Cu concentration correlates with the Cu/Fe light-emitting intensity ratio. These results are illustrated in FIG. 2. As illustrated in FIG. 2, in Steel type MD3 not containing Te, the adhesion was good in each case and there was no correlation between the Cu concentration at the interface region between the primary coating film and the steel sheet and the adhesion. On the other hand, in Steel type MD4 containing Te, the adhesion was good in the case of the Cu concentration at the interface region between the primary coating film and the steel sheet being low (the Cu/Fe light-emitting intensity ratio being 0.30 or less).

In the case where Cu and the specific element such as Te coexist in the steel, when an oxide film containing an internal oxide $SiO_2$ generated by decarburization annealing reacts with MgO in the annealing separating agent at the time of finish annealing, Cu and the specific element such as Te concentrated on the surface of the steel sheet together segregate to the interface between the steel sheet and the oxide film to form a liquid phase film. It is inferred that the adhesion of the primary coating film deteriorates because this liquid phase film suppresses the reaction of the oxide film containing the internal oxide $SiO_2$ with MgO to planarize the structure of the interface between the primary coating film and the steel sheet.

Accordingly, it is conceived that as long as a steel sheet with a reduced Cu concentration on the surface of the steel sheet is used as the steel sheet before being subjected to the annealing separating agent application in the case of manufacture of the grain-oriented electrical steel sheet using the silicon steel material containing a specific element and Cu, it is possible to manufacture a grain-oriented electrical steel sheet with a low Cu concentration at an interface region between a primary coating film and the steel sheet, and obtain a high magnetic flux density and excellent adhesion of the primary coating film.

The present invention has been made as a result of the above examinations. Hereinafter, there will be explained a grain-oriented electrical steel sheet, a decarburized steel sheet for the grain-oriented electrical steel sheet, and so on according to embodiments of the present invention.

There will be explained chemical compositions of the decarburized steel sheet for a grain-oriented electrical steel sheet according to the embodiment of the present invention and a slab used for its manufacture. Although their details will be described later, the decarburized steel sheet for a grain-oriented electrical steel sheet according to the embodiment of the present invention is manufactured by going through slab heating, hot rolling, hot-rolled sheet annealing, cold rolling, decarburization annealing, and so on. Thus, the chemical compositions of the decarburized steel sheet for a grain-oriented electrical steel sheet and the slab used for its manufacture consider not only properties of the decarburized steel sheet, but also these treatments. In the following explanation, being the unit of the content of each element contained in the decarburized steel sheet for a grain-oriented electrical steel sheet or the slab means "mass %" unless otherwise noted. The decarburized steel sheet for a grain-oriented electrical steel sheet according to this embodiment includes a chemical composition represented by C: 0.03% to 0.15%, Si: 1.8% to 7.0%, Mn: 0.02% to 0.30%, S: 0.005% to 0.040%, acid-soluble Al: 0.010% to 0.065%, N: 0.0030% to 0.0150%, Cu: 0.03% to 0.60%, Sn: 0% to 0.5%, Ge, Se, Sb, Te, Pb, or Bi, or an arbitrary combination of these: 0.0005% to 0.030% in total, and the balance: Fe and impurities. Examples of the impurities include ones contained in raw materials such as ore and scrap and ones contained in manufacturing steps.

(C: 0.03% to 0.15%)

C stabilizes secondary recrystallization. When the C content is less than 0.03%, crystal grains grow abnormally at the time of slab heating, and the secondary recrystallization becomes insufficient in finish annealing when manufacturing the grain-oriented electrical steel sheet. Thus, the C content is set to 0.03% or more. When the C content is greater than 0.15%, the time taken for decarburization annealing after cold rolling is prolonged and further decarburization becomes likely to be insufficient, so that magnetic aging is caused in a product. Thus, the C content is set to 0.15% or less.

(Si: 1.8% to 7.0%)

Si increases an electrical resistance of steel to reduce an eddy current loss. When the Si content is less than 1.8%, it is impossible to suppress the eddy current loss of the product. Thus, the Si content is set to 1.8% or more. When the Si content is greater than 7.0%, workability deteriorates significantly, to thus make it difficult to perform cold rolling at normal temperature. Thus, the Si content is set to 7.0% or less.

(Mn: 0.02% to 0.30%)

Mn forms MnS functioning as an inhibitor. When the Mn content is less than 0.02%, MnS necessary for causing the secondary recrystallization falls short. Thus, the Mn content is set to 0.02% or more. When the Mn content is greater than 0.30%, it becomes difficult to solid-dissolve MnS at the time of slab heating, and further the size of MnS to precipitate again at the time of hot rolling becomes likely to be coarse. Thus, the Mn content is set to 0.30% or less.

(S: 0.005% to 0.040%)

S forms MnS functioning as an inhibitor with Mn. When the S content is less than 0.005%, it is impossible to obtain an inhibitor effect sufficient for exhibiting the secondary recrystallization. Thus, the S content is set to 0.005% or more. When the S content is greater than 0.040%, edge cracking becomes likely to occur at the time of hot rolling. Thus, the S content is set to 0.040% or less.

(Acid-Soluble Al: 0.010% to 0.065%)

Al forms AlN functioning as an inhibitor. When the Al content is less than 0.010%, AlN falls short and an inhibitor strength is low, and thus an effect of the above is not exhibited. Thus, the Al content is set to 0.010% or more. When the Al content is greater than 0.065%, AlN becomes coarse to reduce the inhibitor strength. Thus, the Al content is set to 0.065% or less.

(N: 0.0030% to 0.0150%)

N forms AlN functioning as an inhibitor with Al. When the N content is less than 0.0030%, it is impossible to obtain a sufficient inhibitor effect. Thus, the N content is set to 0.0030% or more. When the N content is greater than 0.0150%, surface flaws called blisters occur. Thus, the N content is set to 0.0150% or less.

(Cu: 0.03% to 0.60%)

Cu remains in the steel sheet to increase a specific resistance of the steel sheet and reduce a core loss. Further, Cu strengthens the inhibitors necessary for the secondary recrystallization and increases a magnetic flux density of the grain-oriented electrical steel sheet. When the Cu content is less than 0.03%, it is impossible to sufficiently obtain a function effect of the above and stably manufacture a grain-oriented electrical steel sheet having a high magnetic flux density. Thus, the Cu content is set to 0.03% or more. When the Cu content is greater than 0.60%, the function effect is saturated. Thus, the Cu content is set to 0.60% or less.

(Ge, Se, Sb, Te, Pb, or Bi, or an arbitrary combination of these: 0.0005% to 0.030% in total)

Ge, Se, Sb, Te, Pb, and Bi strengthen the inhibitors, improve the magnetic flux density, and contribute to stable manufacture of a grain-oriented electrical steel sheet having a magnetic flux density $B_8$ of 1.94 T or more. When Ge, Se, Sb, Te, Pb, or Bi, or an arbitrary combination of these is less than 0.0005% in total, an effect of the above is small. Thus, Ge, Se, Sb, Te, Pb, or Bi, or an arbitrary combination of these is set to 0.0005% or more in total. When Ge, Se, Sb, Te, Pb, or Bi, or an arbitrary combination of these is greater than 0.030% in total, coating film adhesion deteriorates significantly as well as saturation of the effect. Thus, Ge, Se, Sb, Te, Pb, or Bi, or an arbitrary combination of these is set to 0.030% or less in total. Go, Se, Sb, Te, Pb, and Bi each have a small solid solubility in iron, and are likely to aggregate at the interface between the primary coating film and the steel sheet, or at the interface between precipitates and the steel sheet. Such a property is effective for strengthening the inhibitors, but tends to adversely affect formation of the primary coating film, so that it is inferred that the property impairs the coating film adhesion.

Sn is not an essential element, but an arbitrary element that may be appropriately contained, up to a predetermined amount as a limit, in the decarburized steel sheet for a grain-oriented electrical steel sheet.

(Sn: 0% to 0.5%)

Sn stabilizes the secondary recrystallization and makes the diameter of secondary recrystallized grains small. Thus, Sn may be contained. The Sn content is preferably set to 0.05% or more in order to sufficiently obtain a function effect of the above. When the Sn content is greater than 0.5%, the function effect is saturated. Thus, the Sn content is set to 0.5% or less. In order to more reduce occurrence of cracking during cold rolling to thereby more increase a yield of the product, the Sn content is preferably set to 0.2% or less.

The decarburized steel sheet for a grain-oriented electrical steel sheet according to the embodiment of the present invention includes an oxide film on the surface of the steel sheet, and a Cu/Fe light-emitting intensity ratio at an interface region between the oxide film and the surface of the steel sheet is 0.60 or less. The Cu/Fe light-emitting intensity ratio at the interface region between the oxide film formed by decarburization annealing and the surface of the steel sheet is 0.60 or less, thereby preventing an increase in Cu concentration at an interface region between the primary coating film to be formed thereafter and the steel sheet. For obtaining higher adhesion between the primary coating film and the steel sheet, the Cu/Fe light-emitting intensity ratio at the interface region between the oxide film and the surface of the steel sheet is preferably 0.40 or less.

Figure 3:
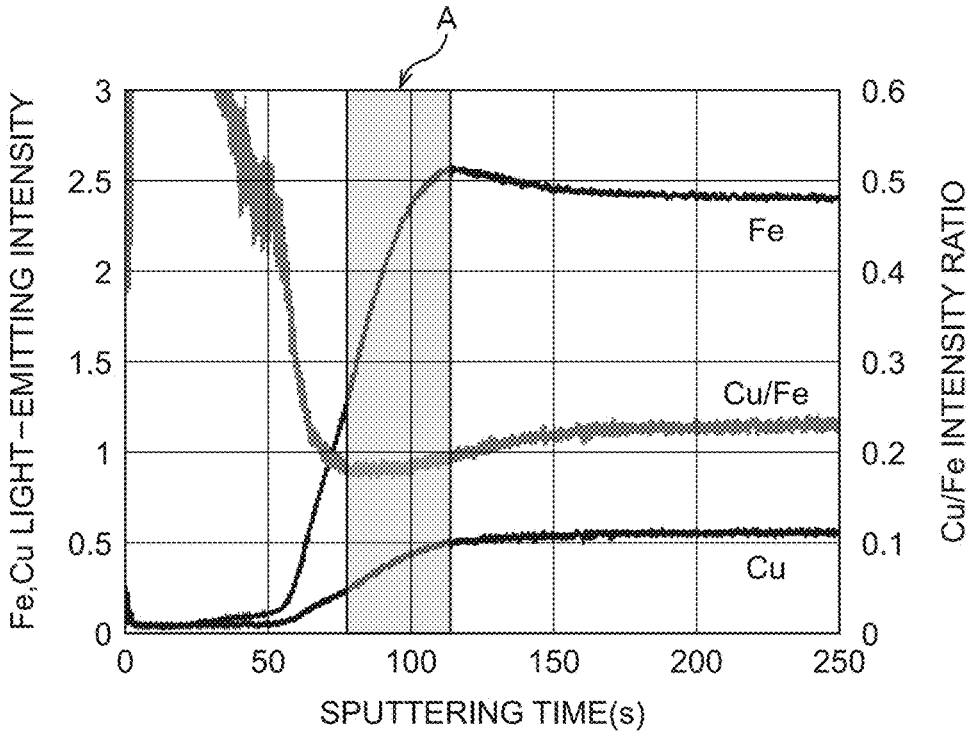
FIG. 3 is a chart illustrating measurement examples of an Fe light-emitting intensity, a Cu light-emitting intensity, and a Cu/Fe light-emitting intensity ratio by GDS analysis.

The Cu/Fe light-emitting intensity ratio obtained by using the GDS analysis is substituted for the Cu concentration at the interface region between the oxide film in the decarburized steel sheet and the steel sheet. This is because the Cu concentration correlates with the Cu/Fe light-emitting intensity ratio. The interface region means the following region. Measurement of element distributions in a depth direction by the GDS analysis reveals that the peak strengths of O and Si, which are the main elements forming the oxide film, decrease from the surface of the decarburized steel sheet to the inside, while the peak strength of Fe increases. The interface region is a region ranging between the depth from the surface of the decarburized steel sheet that corresponds to the sputtering time when the peak strength of Fe becomes maximum and the depth from the surface of the decarburized steel sheet that corresponds to the sputtering time when the peak strength of Fe becomes ½ of the maximum peak strength. In the GDS analysis, detection wavelengths used when measuring the Cu light-emitting intensity and the Fe light-emitting intensity are set to 327.396 nm and 271.903 nm respectively. Measurement examples of the Fe light-emitting intensity, the Cu light-emitting intensity, and the Cu/Fe light-emitting intensity ratio, which are obtained by using the GDS analysis, are illustrated in FIG. 3. A region A in FIG. 3 is the interface region specified as above. The Cu/Fe light-emitting intensity ratio is evaluated by the "average of (Cu light-emitting intensities/Fe light-emitting intensities) at respective measurement points in the interface region" at the interface region specified as above.

Next, the chemical composition of the grain-oriented electrical steel sheet according to the embodiment of the present invention will be explained. Although its detail will be described later, the grain-oriented electrical steel sheet according to the embodiment of the present invention is manufactured by going through slab heating, hot rolling, hot-rolled sheet annealing, cold rolling, annealing separating agent application, finish annealing, and so on. Purification annealing may be included in the finish annealing. Thus, the chemical composition of the grain-oriented electrical steel sheet considers not only properties of the grain-oriented electrical steel sheet, but also these treatments. In the following explanation, "%" being the unit of the content of each element contained in the grain-oriented electrical steel sheet means "mass %" unless otherwise noted. The grain-oriented electrical steel sheet according to this embodiment includes a chemical composition represented by Si: 1.8% to 7.0%, Cu: 0.03% to 0.60%, and the balance: Fe and impurities. Examples of the impurities include ones contained in raw materials such as ore and scrap and ones contained in manufacturing steps, and concretely, Mn, Al, C, N, S, and so on are taken as an example. Further, an element such as B derived from the annealing separating agent may remain as an impurity.

(Si: 1.8% to 7.0%)

Si increases an electrical resistance of steel to reduce an eddy current loss. When the Si content is less than 1.8%, it is impossible to obtain a function effect of the above. Thus, the Si content is set to 1.8% or more. When the Si content is greater than 7.0%, workability deteriorates significantly. Thus, the Si content is set to 7.0% or less.

(Cu: 0.03% to 0.60%)

Cu strengthens the function of inhibitors at the time of manufacture of the grain-oriented electrical steel sheet and highly accumulates crystal grain orientations of a product in the {110}<001> orientation, and containing Cu with a specific element further increases an effect of the above. Further, even when remaining finally, Cu increases a specific resistance to reduce a core loss. When the Cu content is less than 0.03%, it is impossible to sufficiently obtain a function effect of the above. Thus, the Cu content is set to 0.03% or more. When the Cu content is greater than 0.60%, the function effect is saturated. Thus, the Cu content is set to 0.60% or less. Incidentally, in the case where scrap is mixed as a raw material when melting the steel, Cu may be mixed in from the scrap.

The grain-oriented electrical steel sheet according to the embodiment of the present invention includes a primary coating film containing forsterite on the surface of the steel sheet, and a Cu/Fe light-emitting intensity ratio at an interface region between the primary coating film and the surface of the steel sheet is 0.30 or less. Forsterite, which is the main component out of components composing the primary coating film, is contained by 70 mass % or more. The Cu/Fe light-emitting intensity ratio is 0.30 or less, thereby making it possible to obtain a grain-oriented electrical steel sheet excellent in adhesion between the primary coating film and the steel sheet. For obtaining higher adhesion between the primary coating film and the steel sheet, the Cu/Fe light-emitting intensity ratio at the interface region between the primary coating film and the surface of the steel sheet is preferably 0.20 or less.

The Cu/Fe light-emitting intensity ratio obtained by using the GDS analysis is substituted for the Cu concentration at the interface region between the primary coating film in the grain-oriented electrical steel sheet and the steel sheet. This is because the Cu concentration correlates with the Cu/Fe light-emitting intensity ratio. The interface region means the following region. Measurement of element distributions in the depth direction by the GDS analysis reveals that the peak strengths of O, Mg, and Si, which are the main elements forming the primary coating film, decrease from the surface of the grain-oriented electrical steel sheet to the inside, while the peak strength of Fe increases. The interface region is a region ranging between the depth from the surface of the grain-oriented electrical steel sheet that corresponds to the sputtering time when the peak strength of Fe becomes maximum and the depth from the surface of the grain-oriented electrical steel sheet that corresponds to the sputtering time when the peak strength of Fe becomes ½ of the maximum peak strength. Incidentally, the depth from the surface of the grain-oriented electrical steel sheet corresponding to the sputtering time when the peak strength of Fe becomes maximum is also substantially equivalent to the depth where the peak strength of Mg is no longer detected. In the GDS analysis, detection wavelengths used when measuring the Cu light-emitting intensity and the Fe light-emitting intensity are set to 327.396 nm and 271.903 nm respectively.

Next, there will be explained a manufacturing method of the decarburized steel sheet for a grain-oriented electrical steel sheet according to the embodiment of the present invention. In the manufacturing method of the decarburized steel sheet for a grain-oriented electrical steel sheet according to this embodiment, there are performed slab heating, hot rolling, hot-rolled sheet annealing, cold rolling, decarburization annealing, pickling, and so on.

First, a molten steel used for manufacture of the above-described decarburized steel sheet is formed into a slab by an ordinary method, and then the slab is heated and subjected to hot rolling.

When the slab heating temperature is less than 1300° C., it is impossible to melt precipitates such as MnS, so that the variation in magnetic flux density of the product is large. Thus, the slab heating temperature is set to 1300° C. or more. When the slab heating temperature is greater than 1490° C., the slab melts. Thus, the slab heating temperature is set to 1490° C. or less.

In the hot rolling, rough rolling with a finishing temperature set to 1200° C. or less is performed, and finish rolling with a start temperature set to 1000° C. or more and a finishing temperature set to 950° C. to 1100° C. is performed. When the finishing temperature of the rough rolling is greater than 1200° C., precipitation of MnS or MnSe in the rough rolling is not promoted, resulting in that $Cu_2S$ is generated in the finish rolling and the magnetic property of the product deteriorates. Thus, the finishing temperature of the rough rolling is set to 1200° C. or less. When the start temperature of the finish rolling is less than 1000° C., the finishing temperature of the finish rolling falls below 950° C., resulting in that $Cu_2S$ becomes likely to precipitate and the magnetic property of the product does not stabilize. Thus, the start temperature of the finish rolling is set to 1000° C. or more. When the finishing temperature of the finish rolling is less than 950° C., $Cu_2S$ becomes likely to precipitate and the magnetic property does not stabilize. Further, when the difference in temperature from the slab heating temperature is too large, it is difficult to make temperature histories over the entire length of a hot-rolled coil uniform, and thus it becomes difficult to form homogeneous inhibitors over the entire length of the hot-rolled coil. Thus, the finishing temperature of the finish rolling is set to 950° C. or more. When the finishing temperature of the finish rolling is greater than 1100° C., it is impossible to control fine dispersion of MnS and MnSe. Thus, the finishing temperature of the finish rolling is set to 1100° C. or less.

The finish rolling is started within 300 seconds after start of the rough rolling. When the time period between start of the rough rolling and start of the finish rolling is greater than 300 seconds, MnS or MnSe having 50 nm or less, which functions as an inhibitor, is no longer dispersed, grain diameter control in decarburization annealing and secondary recrystallization in finish annealing become difficult, and the magnetic property deteriorates. Thus, the time period between start of the rough rolling and start of the finish rolling is set to within 300 seconds. Incidentally, the lower limit of the time period does not need to be set in particular as long as the rolling is normal rolling. When the time period between start of the rough rolling and start of the finish rolling is less than 30 seconds, a precipitation amount of MnS or MnSe is not sufficient and secondary recrystallized crystal grains become difficult to grow at the time of finish annealing in some cases.

Cooling at a cooling rate of 50° C./second or more is started within 10 seconds after finish of the finish rolling. When the time period between finish of the finish rolling and start of the cooling is greater than 10 seconds, $Cu_2S$ becomes likely to precipitate and the magnetic property of the product does not stabilize. Thus, the time period between finish of the finish rolling and start of the cooling is set to within 10 seconds, and preferably set to within two seconds. When the cooling rate after the finish rolling is less than 50° C./second, $Cu_2S$ becomes likely to precipitate and the magnetic property of the product does not stabilize. Thus, the cooling rate after the finish rolling is set to 50° C./second or more.

Thereafter, coiling is performed in a temperature zone of 600° C. or less. When the coiling temperature is greater than 600° C., $Cu_2S$ becomes likely to precipitate and the magnetic property of the product does not stabilize. Thus, the coiling temperature is set to 600° C. or less.

Next, hot-rolled sheet annealing of an obtained hot-rolled steel sheet is performed. When the finishing temperature of the finish rolling is set to Tf, the holding temperature of the hot-rolled sheet annealing is set to 950° C. to (Tf+100° C.). When the holding temperature is less than 950° C., it is impossible to make the inhibitors homogeneous over the entire length of the hot-rolled coil and the magnetic property of the product does not stabilize. Thus, the holding temperature is set to 950° C. or more. When the holding temperature is greater than (Tf+100)° C., MnS that has finely precipitated in the hot rolling grows rapidly and the secondary recrystallization is destabilized. Thus, the holding temperature is set to (Tf+100°) C. or less.

Next, one cold rolling, or two or more cold rollings with intermediate annealing therebetween are performed to obtain a cold-rolled steel sheet. Thereafter, decarburization annealing of the cold-rolled steel sheet is performed. By performing the decarburization annealing, an oxide film containing $SiO_2$ is formed on the surface of the steel sheet. The cold rolling and the decarburization annealing can be performed by general methods.

After the hot rolling and before finish of the cold rolling, for example, between the hot rolling and the hot-rolled sheet annealing, or between the hot-rolled sheet annealing and the cold rolling, pickling with a holding temperature set to 50° C. or more and a holding time period set to 30 seconds or more is performed in a pickling bath containing a nitric acid, a pickling inhibitor, and a surface active agent. Performing such pickling enables a Cu concentrated portion on the surface of the steel sheet to be removed. Removing the Cu concentrated portion enables the Cu/Fe light-emitting intensity ratio obtained by the GDS analysis to be 0.60 or less in terms of the Cu concentration on the surface of the decarburized steel sheet resulting from the decarburization annealing. When the content of the nitric acid is less than 5 g/l, it is impossible to sufficiently remove the Cu concentrated portion. Thus, the content of the nitric acid is set to 5 g/l or more. When the content of the nitric acid is greater than 200 g/l, its function effect is saturated and its cost increases. Thus, the content of the nitric acid is set to 200 g/l or less. When the content of the pickling inhibitor is less than 0.5 g/l, excessive dissolution of the surface of the steel sheet occurs locally to make the surface uneven and extremely rough. Thus, the content of the pickling inhibitor is set to 0.5 g/l or more. When the content of the pickling inhibitor is greater than 10 g/l, its function effect is saturated and its cost increases. Thus, the content of the pickling inhibitor is set to 10 g/l or less. When the content of the surface active agent is less than 0.5 g/l, it is impossible to sufficiently remove the Cu concentrated portion. Thus, the content of the surface active agent is set to 0.5 g/l or more. When the content of the surface active agent is greater than 10 g/l, its function effect is saturated and its cost increases. Thus, the content of the surface active agent is set to 10 g/l or less. When the holding temperature is less than 50° C., the rate of removing scales by the pickling decreases significantly and the productivity decreases. Thus, the holding temperature is set to 50° C. or more. When the holding time period is less than 30 seconds, it is impossible to sufficiently remove scales. Thus, the holding time period is set to 30 seconds or more.

As the pickling inhibitor, it is possible to use an organic inhibitor preferably, and for example, an amine derivative, mercaptans, sulfides, thiourea and its derivative, or the like can be used. As the surface active agent, it is possible to use ethylene glycol, glycerin, or the like preferably.

The pickling bath may contain a nitrate, for example, sodium nitrate. The pickling is performed in the pickling bath containing a nitrate, thereby enabling more secure removal of the Cu concentrated portion on the surface of the steel sheet and enabling the Cu/Fe light-emitting intensity ratio obtained by the GDS analysis to be 0.40 or less in terms of the Cu concentration on the surface of the decarburized steel sheet resulting from the decarburization annealing. When the content of the nitrate is less than 0.5 g/l, it is sometimes impossible to securely remove the Cu concentrated portion. Thus, the content of the nitrate is set to 0.5 g/l or more. When the content of the nitrate is greater than 10 g/l, its function effect is saturated and its cost increases. Thus, the content of the nitrate is set to 10 g/l or less.

In this manner, it is possible to manufacture the decarburized steel sheet for a grain-oriented electrical steel sheet according to this embodiment.

Next, there will be explained a manufacturing method of the grain-oriented electrical steel sheet according to the embodiment of the present invention. In the manufacturing method of the grain-oriented electrical steel sheet according to this embodiment, there are performed slab heating, hot rolling, hot-rolled sheet annealing, cold rolling, decarburization annealing, annealing separating agent application, finish annealing, pickling, and so on. The slab heating, the hot rolling, the hot-rolled sheet annealing, the cold rolling, the decarburization annealing, and the pickling can be performed similarly to the above-described manufacturing method of the decarburized steel sheet for a grain-oriented electrical steel sheet.

The obtained decarburized steel sheet has an annealing separating agent containing MgO applied thereto to be subjected to finish annealing. Pickling is performed after hot rolling and before finish of cold rolling. The annealing separating agent contains MgO, and the ratio of MgO in the annealing separating agent is 90 mass % or more, for example. In the finish annealing, purification annealing may be performed after the secondary recrystallization is completed. The annealing separating agent application and the finish annealing can be performed by general methods.

The pickling is performed to control the Cu concentration on the surface of the steel sheet, and thereby the Cu/Fe light-emitting intensity ratio obtained by the GDS analysis becomes 0.30 or less, in terms of the Cu concentration at an interface region between a primary coating film mainly composed of forsterite formed on the surface of the steel sheet after finish annealing to be performed thereafter and the steel sheet. Further, the pickling is performed in a pickling bath containing a nitrate, thereby enabling more secure removal of the Cu concentrated portion on the surface of the steel sheet and enabling the Cu/Fe light-emitting intensity ratio obtained by the GDS analysis to be 0.20 or less in terms of the Cu concentration at the interface region between the primary coating film formed on the surface of the steel sheet after the finish annealing and the steel sheet.

In this manner, it is possible to manufacture the grain-oriented electrical steel sheet according to this embodiment. After the finish annealing, an insulating coating film may be formed by application and baking.

From the above, according to the manufacturing method of the decarburized steel sheet for a grain-oriented electrical steel sheet and the manufacturing method of the grain-oriented electrical steel sheet according to the embodiments of the present invention, it is possible to appropriately control the Cu concentration on the surface of the steel sheet and obtain the grain-oriented electrical steel sheet having a good magnetic property and having excellent adhesion between the primary coating film and the steel sheet and the decarburized steel sheet for the grain-oriented electrical steel sheet.

In the foregoing, the preferred embodiments of the present invention have been described in detail, but, the present invention is not limited to such examples. It is apparent that a person having common knowledge in the technical field to which the present invention belongs is able to devise various variation or modification examples within the range of technical ideas described in the claims, and it should be understood that such examples belong to the technical scope of the present invention as a matter of course.

EXAMPLE

Next, the decarburized steel sheet for a grain-oriented electrical steel sheet and the grain-oriented electrical steel sheet according to the embodiments of the present invention will be explained concretely while referring to examples. The following examples are merely examples of the decarburized steel sheet for a grain-oriented electrical steel sheet and the grain-oriented electrical steel sheet according to the embodiments of the present invention, and the decarburized steel sheet for a grain-oriented electrical steel sheet and the grain-oriented electrical steel sheet according to the present invention are not limited to the following examples.

In a vacuum melting furnace, silicon steel materials having chemical compositions of Steel type MD4 to Steel type MD10 illustrated in Table 1 were fabricated, and after being heated at temperatures illustrated in Table 3 to Table 5, slabs were subjected to hot rolling under conditions illustrated in Table 3 to Table 5 to obtain hot-rolled steel sheets having a sheet thickness of 2.3 mm, and they were coiled at temperatures illustrated in Table 3 to Table 5. Then, after being annealed, the hot-rolled steel sheets were subjected to pickling using a pickling bath B1 to a pickling bath B3 illustrated in Table 6. As a nitrate contained in the pickling bath B2, sodium nitrate was used. Thereafter, cold rolling was performed under conditions illustrated in Table 3 to Table 5, and cold-rolled steel sheets having a sheet thickness of 0.22 mm were obtained. Then, the obtained cold-rolled steel sheets were subjected to primary recrystallization annealing including decarburization annealing, to thereby obtain decarburized steel sheets, and then the decarburized steel sheets had an annealing separating agent containing MgO as its main component applied thereto and were subjected to finish annealing, and an insulating coating film was applied to obtained finish-annealed sheets to be baked to obtain grain-oriented electrical steel sheets.

Each sample was taken from the obtained decarburized steel sheets and grain-oriented electrical steel sheets to be subjected to GDS analysis, the Cu light-emitting intensity and the Fe light-emitting intensity at the interface region between the oxide film and the steel sheet were measured in each of the decarburized steel sheets, and the Cu light-emitting intensity and the Fe light-emitting intensity at the interface region between the primary coating film mainly composed of forsterite and the steel sheet were measured in each of the grain-oriented electrical steel sheets to obtain each Cu/Fe light-emitting intensity ratio. Each sample was taken from the obtained grain-oriented electrical steel sheets to measure each magnetic flux density $B_8$. Each sample was taken from a portion 50 mm apart from the end in the coil width direction in the finish annealing and from the center portion in the coil width direction, and they were each subjected to a bending test in which each sample was wound on a 20-mm ϕ cylindrical body. The length of the portion deformed on a curved surface of the cylindrical body by this bending was about 30 mm, and each coating film adhesion was evaluated according to a coating film residual ratio in the deformed portion. As for the evaluation of the coating film adhesion, the case of the coating film residual ratio being 70% or more was judged to be excellent in coating film adhesion. These results are illustrated in Table 3 to Table 5. Incidentally, each underline in Table 3 to Table 5 indicates that a corresponding numerical value is outside the range of the present invention. Each underline in Table 6 indicates that a corresponding condition is outside the range of the present invention.

TABLE 3

| | | | HOT ROLLING | | | | COOLING | |
|---|---|---|---|---|---|---|---|---|
| | | | ROUGH ROLLING | | FINISH ROLLING | FINISH ROLLING | | |
| SAMPLE No. | STELL TYPE | SLAB HEATING TEMPERATURE (° C.) | FINISHING TEMPERATURE (° C.) | STANDBY TIME (SECOND) | START TEMPERATURE (° C.) | FINISHING TEMPERATURE (° C.) | STANDBY TIME (SECOND) | COOLING RATE (° C./SECOND) |
| 1 | MD4 | 1350 | 1150 | 60 | 1100 | 1060 | 1.2 | 80 |
| 2 | MD4 | 1350 | 1150 | 60 | 1100 | 1060 | 1.2 | 80 |
| 3 | MD4 | 1350 | 1150 | 60 | 1100 | 1060 | 1.2 | 80 |
| 4 | MD4 | 1280 | 1110 | 30 | 1080 | 1050 | 1 | 80 |
| 5 | MD4 | 1500 | | | HOT ROLLING IMPOSSIBLE | | | |
| 6 | MD4 | 1350 | 1220 | 80 | 1100 | 1050 | 1 | 80 |
| 7 | MD4 | 1350 | 1150 | 320 | 1100 | 1050 | 1 | 80 |
| 8 | MD4 | 1350 | 1150 | 110 | 980 | 1000 | 1 | 80 |
| 9 | MD4 | 1350 | 1150 | 60 | 1100 | 930 | 1 | 60 |

TABLE 3-continued

| | | | | | | | | |
|---|---|---|---|---|---|---|---|---|
| 10 | MD4 | 1350 | 1150 | 10 | 1130 | 1120 | 1 | 90 |
| 11 | MD4 | 1350 | 1150 | 60 | 1100 | 1060 | 12 | 80 |
| 12 | MD4 | 1350 | 1150 | 60 | 1100 | 1060 | 1.2 | 45 |
| 13 | MD4 | 1350 | 1150 | 60 | 1100 | 1060 | 1.2 | 80 |
| 14 | MD5 | 1350 | 1150 | 60 | 1100 | 1060 | 1.2 | 80 |
| 15 | MD5 | 1350 | 1150 | 60 | 1100 | 1060 | 1.2 | 80 |
| 16 | MD5 | | 1150 | 60 | 1100 | 1060 | 1.2 | 80 |
| 17 | MD5 | 1280 | 1110 | 30 | 1080 | 1050 | 1 | 80 |
| 18 | MD5 | 1500 | HOT ROLLING IMPOSSIBLE | | | | | |
| 19 | MD5 | 1350 | 1220 | 80 | 1100 | 1050 | 1 | 80 |
| 20 | MD5 | 1350 | 1150 | 320 | 1100 | 1050 | 1 | 80 |
| 21 | MD5 | 1350 | 1150 | 110 | 980 | 1000 | 1 | 80 |
| 22 | MD5 | 1350 | 1150 | 60 | 1100 | 930 | 1 | 60 |
| 23 | MD5 | 1350 | 1150 | 10 | 1130 | 1120 | 1 | 90 |
| 24 | MD5 | 1350 | 1150 | 60 | 1100 | 1060 | 12 | 80 |
| 25 | MD5 | 1350 | 1150 | 60 | 1100 | 1060 | 1.2 | 45 |
| 26 | MD5 | 1350 | 1150 | 60 | 1100 | 1060 | 1.2 | 80 |
| 27 | MD6 | 1350 | 1150 | 60 | 1100 | 1060 | 1.2 | 80 |
| 28 | MD6 | 1350 | 1150 | 60 | 1100 | 1060 | 1.2 | 80 |
| 29 | MD6 | 1350 | 1150 | 60 | 1100 | 1060 | 1.2 | 80 |
| 30 | MD6 | 1280 | 1110 | 30 | 1080 | 1050 | 1 | 80 |

| | | | DECARBURIZED | GRAIN-ORIENTED ELECTRICAL STEEL SHEET | | |
|---|---|---|---|---|---|---|
| SAMPLE No. | COILING TEMPERATURE (° C.) | PICKLING BATH TYPE | STEEL SHEET LIGHT-EMITTING INTENSITY RATIO | LIGHT-EMMITING INTENSITY RATIO | MAGNETIC FLUX DENSITY $B_8$ (T) | COATING FILM RESIDUAL RATIO (%) |
| 1 | 550 | B1 | 0.52 | 0.28 | 1.94 | 95 |
| 2 | 550 | B2 | 0.40 | 0.15 | 1.94 | 100 |
| 3 | 550 | B3 | 0.65 | 0.41 | 1.94 | 50 |
| 4 | 550 | B2 | 0.41 | 0.17 | 1.82 | 100 |
| 5 | HOT ROLLING IMPOSSIBLE | B2 | MEASUREMENT IMPOSSIBLE | | | |
| 6 | 550 | B2 | 0.40 | 0.15 | 1.88 | 100 |
| 7 | 550 | B2 | 0.40 | 0.15 | 1.83 | 100 |
| 8 | 550 | B2 | 0.40 | 0.15 | 1.86 | 100 |
| 9 | 550 | B2 | 0.40 | 0.15 | 1.89 | 100 |
| 10 | 550 | B2 | 0.40 | 0.15 | 1.83 | 100 |
| 11 | 550 | B2 | 0.40 | 0.16 | 1.88 | 100 |
| 12 | 550 | B2 | 0.40 | 0.15 | 1.89 | 100 |
| 13 | 620 | B2 | 0.40 | 0.16 | 1.92 | 100 |
| 14 | 550 | B1 | 0.80 | 0.60 | 1.90 | 50 |
| 15 | 550 | B2 | 0.70 | 0.50 | 1.91 | 50 |
| 16 | 550 | B3 | 1.10 | 0.80 | 1.90 | 40 |
| 17 | 550 | B2 | 0.72 | 0.55 | 1.90 | 40 |
| 18 | HOT ROLLING IMPOSSIBLE | B2 | MEASUREMENT IMPOSSIBLE | | | |
| 19 | 550 | B2 | 0.72 | 0.52 | 1.88 | 50 |
| 20 | 550 | B2 | 0.72 | 0.52 | 1.85 | 50 |
| 21 | 550 | B2 | 0.72 | 0.50 | 1.90 | 30 |
| 22 | 550 | B2 | 0.72 | 0.52 | 1.90 | 30 |
| 23 | 550 | B2 | 0.72 | 0.52 | 1.86 | 50 |
| 24 | 550 | B2 | 0.72 | 0.52 | 1.91 | 30 |
| 25 | 550 | B2 | 0.72 | 0.55 | 1.90 | 50 |
| 26 | 620 | B2 | 0.72 | 0.55 | 1.88 | 40 |
| 27 | 550 | B1 | 0.25 | 0.18 | 1.94 | 90 |
| 28 | 550 | B2 | 0.20 | 0.10 | 1.94 | 100 |
| 29 | 550 | B3 | 0.40 | 0.35 | 1.94 | 70 |
| 30 | 550 | B2 | 0.40 | 0.35 | 1.94 | 95 |

TABLE 4

| | | | HOT ROLLING | | | | COOLING | |
|---|---|---|---|---|---|---|---|---|
| | | | ROUGH ROLLING | | FINISH ROLLING | FINISH ROLLING | | |
| SAMPLE No. | STELL TYPE | SLAB HEATING TEMPERATURE (° C.) | FINISHING TEMPERATURE (° C.) | STANDBY TIME (SECOND) | START TEMPERATURE (° C.) | FINISHING TEMPERATURE (° C.) | STANDBY TIME (SECOND) | COOLING RATE (° C./SECOND) |
| 31 | MD6 | 1500 | HOT ROLLING IMPOSSIBLE | | | | | |
| 32 | MD6 | 1350 | 1220 | 80 | 1100 | 1050 | 1 | 80 |

TABLE 4-continued

| | | | | | | | | |
|---|---|---|---|---|---|---|---|---|
| 33 | MD6 | 1350 | 1150 | 320 | 1100 | 1050 | 1 | 80 |
| 34 | MD6 | 1350 | 1150 | 110 | 980 | 1000 | 1 | 80 |
| 35 | MD6 | 1350 | 1150 | 60 | 1100 | 930 | 1 | 60 |
| 36 | MD6 | 1350 | 1150 | 10 | 1130 | 1120 | 1 | 90 |
| 37 | MD6 | 1350 | 1150 | 60 | 1100 | 1060 | 12 | 80 |
| 38 | MD6 | 1350 | 1150 | 60 | 1100 | 1060 | 1.2 | 45 |
| 39 | MD6 | 1350 | 1150 | 60 | 1100 | 1060 | 1.2 | 80 |
| 40 | MD7 | 1350 | 1150 | 60 | 1100 | 1060 | 1.2 | 80 |
| 41 | MD7 | 1350 | 1150 | 60 | 1100 | 1060 | 1.2 | 80 |
| 42 | MD7 | 1350 | 1150 | 60 | 1100 | 1060 | 1.2 | 80 |
| 43 | MD7 | 1280 | 1110 | 30 | 1080 | 1050 | 1 | 80 |
| 44 | MD7 | 1500 | HOT ROLLING IMPOSSIBLE | | | | | |
| 45 | MD7 | 1350 | 1220 | 80 | 1100 | 1050 | 1 | 80 |
| 46 | MD7 | 1350 | 1150 | 320 | 1100 | 1050 | 1 | 80 |
| 47 | MD7 | 1350 | 1150 | 110 | 980 | 1000 | 1 | 80 |
| 48 | MD7 | 1350 | 1150 | 60 | 1100 | 930 | 1 | 60 |
| 49 | MD7 | 1350 | 1150 | 10 | 1130 | 1120 | 1 | 90 |
| 50 | MD7 | 1350 | 1150 | 60 | 1100 | 1060 | 12 | 80 |
| 51 | MD7 | 1350 | 1150 | 60 | 1100 | 1060 | 1.2 | 45 |
| 52 | MD7 | 1350 | 1150 | 60 | 1100 | 1060 | 1.2 | 80 |
| 53 | MD8 | 1350 | 1150 | 60 | 1100 | 1060 | 1.2 | 80 |
| 54 | MD8 | 1350 | 1150 | 60 | 1100 | 1060 | 1.2 | 80 |
| 55 | MD8 | 1350 | 1150 | 60 | 1100 | 1060 | 1.2 | 80 |
| 56 | MD8 | 1280 | 1110 | 30 | 1080 | 1050 | 1 | 80 |
| 57 | MD8 | 1500 | HOT ROLLING IMPOSSIBLE | | | | | |
| 58 | MD8 | 1350 | 1220 | 80 | 1100 | 1050 | 1 | 80 |
| 59 | MD8 | 1350 | 1150 | 320 | 1100 | 1050 | 1 | 80 |
| 60 | MD8 | 1350 | 1150 | 110 | 980 | 990 | 1 | 80 |

| | | | DECARBURIZED | GRAIN-ORIENTED ELECTRICAL STEEL SHEET | | |
|---|---|---|---|---|---|---|
| SAMPLE No. | COILING TEMPERATURE (° C.) | PICKLING BATH TYPE | STEEL SHEET LIGHT-EMITTING INTENSITY RATIO | LIGHT-EMITTING INTENSITY RATIO | MAGNETIC FLUX DENSITY $B_8$ (T) | COATING FILM RESIDUAL RATIO (%) |
| 31 | HOT ROLLING IMPOSSIBLE | B2 | MEASUREMENT IMPOSSIBLE | | | |
| 32 | 550 | B2 | 0.40 | 0.35 | 1.94 | 95 |
| 33 | 550 | B2 | 0.40 | 0.35 | 1.94 | 95 |
| 34 | 550 | B2 | 0.40 | 0.35 | 1.94 | 95 |
| 35 | 550 | B2 | 0.40 | 0.35 | 1.94 | 95 |
| 36 | 550 | B2 | 0.40 | 0.35 | 1.94 | 95 |
| 37 | 550 | B2 | 0.40 | 0.35 | 1.94 | 95 |
| 38 | 550 | B2 | 0.40 | 0.35 | 1.94 | 95 |
| 39 | 620 | B2 | 0.40 | 0.35 | 1.94 | 95 |
| 40 | 550 | B1 | 0.40 | 0.30 | 1.95 | 90 |
| 41 | 550 | B2 | 0.35 | 0.20 | 1.95 | 100 |
| 42 | 550 | B3 | 0.70 | 0.40 | 1.94 | 60 |
| 43 | 550 | B2 | 0.45 | 0.23 | 1.86 | 100 |
| 44 | HOT ROLLING IMPOSSIBLE | B2 | MEASUREMENT IMPOSSIBLE | | | |
| 45 | 550 | B2 | 0.48 | 0.22 | 1.92 | 100 |
| 46 | 550 | B2 | 0.42 | 0.20 | 1.90 | 100 |
| 47 | 550 | B2 | 0.45 | 0.20 | 1.91 | 100 |
| 48 | 550 | B2 | 0.45 | 0.20 | 1.88 | 100 |
| 49 | 550 | B2 | 0.45 | 0.20 | 1.91 | 100 |
| 50 | 550 | B2 | 0.45 | 0.20 | 1.92 | 100 |
| 51 | 550 | B2 | 0.45 | 0.20 | 1.92 | 100 |
| 52 | 620 | B2 | 0.45 | 0.20 | 1.90 | 100 |
| 53 | 550 | B1 | 0.30 | 0.25 | 1.94 | 95 |
| 54 | 550 | B2 | 0.25 | 0.15 | 1.94 | 100 |
| 55 | 550 | B3 | 0.70 | 0.32 | 1.93 | 50 |
| 56 | 550 | B2 | 0.30 | 0.20 | 1.82 | 100 |
| 57 | HOT ROLLING IMPOSSIBLE | B2 | MEASUREMENT IMPOSSIBLE | | | |
| 58 | 550 | B2 | 0.30 | 0.20 | 1.82 | 100 |
| 59 | 550 | B2 | 0.30 | 0.20 | 1.88 | 100 |
| 60 | 550 | B2 | 0.30 | 0.20 | 1.87 | 100 |

TABLE 5

| | | | HOT ROLLING | | | | COOLING | |
|---|---|---|---|---|---|---|---|---|
| | | | ROUGH ROLLING | | FINISH ROLLING | FINISH ROLLING | | |
| SAMPLE No. | STELL TYPE | SLAB HEATING TEMPERATURE (° C.) | FINISHING TEMPERATURE (° C.) | STANDBY TIME (SECOND) | START TEMPERATURE (° C.) | FINISHING TEMPERATURE (° C.) | STANDBY TIME (SECOND) | COOLING RATE (° C./SECOND) |
| 61 | MD8 | 1350 | 1150 | 60 | 1100 | 930 | 1 | 60 |
| 62 | MD8 | 1350 | 1150 | 10 | 1130 | 1120 | 1 | 90 |
| 63 | MD8 | 1350 | 1150 | 60 | 1100 | 1060 | 12 | 80 |
| 64 | MD8 | 1350 | 1150 | 60 | 1100 | 1060 | 1.2 | 45 |
| 65 | MD8 | 1350 | 1150 | 60 | 1100 | 1060 | 1.2 | 80 |
| 66 | MD9 | 1350 | 1150 | 60 | 1100 | 1060 | 1.2 | 80 |
| 67 | MD9 | 1350 | 1150 | 60 | 1100 | 1060 | 1.2 | 80 |
| 68 | MD9 | 1350 | 1150 | 60 | 1100 | 1060 | 1.2 | 80 |
| 69 | MD9 | 1280 | 1110 | 30 | 1080 | 1050 | 1 | 80 |
| 70 | MD9 | 1500 | HOT ROLLING IMPOSSIBLE | | | | | |
| 71 | MD9 | 1350 | 1220 | 80 | 1100 | 1050 | 1 | 80 |
| 72 | MD9 | 1350 | 1150 | 320 | 1100 | 1050 | 1 | 80 |
| 73 | MD9 | 1350 | 1150 | 110 | 980 | 990 | 1 | 80 |
| 74 | MD9 | 1350 | 1150 | 60 | 1100 | 930 | 1 | 60 |
| 75 | MD9 | 1350 | 1150 | 10 | 1130 | 1120 | 1 | 90 |
| 76 | MD9 | 1350 | 1150 | 60 | 1100 | 1060 | 12 | 80 |
| 77 | MD9 | 1350 | 1150 | 60 | 1100 | 1060 | 1.2 | 45 |
| 78 | MD9 | 1350 | 1150 | 60 | 1100 | 1060 | 1.2 | 80 |
| 79 | MD10 | 1350 | 1150 | 60 | 1100 | 1060 | 1.2 | 80 |
| 80 | MD10 | 1350 | 1150 | 60 | 1100 | 1060 | 1.2 | 80 |
| 81 | MD10 | 1350 | 1150 | 60 | 1100 | 1060 | 1.2 | 80 |
| 82 | MD10 | 1280 | 1110 | 30 | 1080 | 1050 | 1 | 80 |
| 83 | MD10 | 1500 | HOT ROLLING IMPOSSIBLE | | | | | |
| 84 | MD10 | 1350 | 1220 | 80 | 1100 | 1050 | 1 | 80 |
| 85 | MD10 | 1350 | 1150 | 320 | 1100 | 1050 | 1 | 80 |
| 86 | MD10 | 1350 | 1150 | 110 | 980 | 990 | 1 | 80 |
| 87 | MD10 | 1350 | 1150 | 60 | 1100 | 930 | 1 | 60 |
| 88 | MD10 | 1350 | 1150 | 10 | 1130 | 1120 | 1 | 90 |
| 89 | MD10 | 1350 | 1150 | 60 | 1100 | 1060 | 12 | 80 |
| 90 | MD10 | 1350 | 1150 | 60 | 1100 | 1060 | 1.2 | 45 |
| 91 | MD10 | 1350 | 1150 | 60 | 1100 | 1060 | 1.2 | 80 |

| | | | DECARBURIZED | GRAIN-ORIENTED ELECTRICAL STEEL SHEET | | |
|---|---|---|---|---|---|---|
| SAMPLE No. | COILING TEMPERATURE (° C.) | PICKLING BATH TYPE | STEEL SHEET LIGHT-EMITTING INTENSITY RATIO | LIGHT-EMITTING INTENSITY RATIO | MAGNETIC FLUX DENSITY $B_8$ (T) | COATING FILM RESIDUAL RATIO (%) |
| 61 | 550 | B2 | 0.30 | 0.20 | 1.91 | 100 |
| 62 | 550 | B2 | 0.30 | 0.20 | 1.85 | 100 |
| 63 | 550 | B2 | 0.30 | 0.20 | 1.91 | 100 |
| 64 | 550 | B2 | 0.30 | 0.20 | 1.92 | 100 |
| 65 | 620 | B2 | 0.30 | 0.20 | 1.90 | 100 |
| 66 | 550 | B1 | 0.30 | 0.25 | 1.95 | 100 |
| 67 | 550 | B2 | 0.25 | 0.10 | 1.95 | 100 |
| 68 | 550 | B3 | 0.65 | 0.35 | 1.95 | 60 |
| 69 | 550 | B2 | 0.45 | 0.35 | 1.79 | 100 |
| 70 | HOT ROLLING IMPOSSIBLE | B2 | MEASUREMENT IMPOSSIBLE | | | |
| 71 | 550 | B2 | 0.25 | 0.10 | 1.91 | 100 |
| 72 | 550 | B2 | 0.30 | 0.15 | 1.89 | 95 |
| 73 | 550 | B2 | 0.30 | 0.15 | 1.92 | 95 |
| 74 | 550 | B2 | 0.25 | 0.10 | 1.83 | 100 |
| 75 | 550 | B2 | 0.30 | 0.15 | 1.85 | 100 |
| 76 | 550 | B2 | 0.30 | 0.15 | 1.88 | 100 |
| 77 | 550 | B2 | 0.30 | 0.15 | 1.88 | 100 |
| 78 | 620 | B2 | 0.30 | 0.15 | 1.89 | 100 |
| 79 | 550 | B1 | 0.40 | 0.25 | 1.94 | 95 |
| 80 | 550 | B2 | 0.35 | 0.20 | 1.94 | 100 |
| 81 | 550 | B3 | 0.70 | 0.35 | 1.94 | 65 |
| 82 | 550 | B2 | 0.50 | 0.35 | 1.82 | 100 |
| 83 | HOT ROLLING IMPOSSIBLE | B2 | MEASUREMENT IMPOSSIBLE | | | |
| 84 | 550 | B2 | 0.35 | 0.10 | 1.89 | 100 |
| 85 | 550 | B2 | 0.40 | 0.15 | 1.86 | 95 |
| 86 | 550 | B2 | 0.35 | 0.15 | 1.91 | 95 |
| 87 | 550 | B2 | 0.35 | 0.10 | 1.84 | 100 |
| 88 | 550 | B2 | 0.35 | 0.15 | 1.82 | 100 |

TABLE 5-continued

| | | | | | | |
|---|---|---|---|---|---|---|
| 89 | 550 | B2 | 0.40 | 0.15 | 1.87 | 100 |
| 90 | 550 | B2 | 0.35 | 0.15 | 1.88 | 100 |
| 91 | 620 | B2 | 0.35 | 0.15 | 1.88 | 100 |

TABLE 6

| BATH TYPE | PICKLING CONDITION |
|---|---|
| B1 | 8.5% HCl + 0.4% $HNO_3$ + SURFACE ACTIVE AGENT, 85° C., 40-SECOND IMMERSION |
| B2 | 8.5% HCl + 0.4% $HNO_3$ + NITRATE + SURFACE ACTIVE AGENT, 85° C., 40-SECOND IMMERSION |
| B3 | 8.5% HCl, 85° C., 40-SECOND IMMERSION |

As illustrated in Table 3 to Table 5, in Samples No. 1, No. 2, No. 27, No. 28, No. 40, No. 41, No. 53, No. 54, No. 66, No. 67, No. 79, and No. 80, because of the slab heating temperature, the hot rolling condition, the cooling condition, the coiling temperature, the holding temperature of the hot-rolled sheet annealing, and the pickling condition each being within the range of the present invention, good results, which were the Cu/Fe light-emitting intensity ratio in the decarburized steel sheet of 0.60 or less and the Cu/Fe light-emitting intensity ratio in the grain-oriented electrical steel sheet of 0.30 or less, were obtained. Among these samples, in Samples No. 2, No. 28, No. 41, No. 54, No. 67, and No. 80, since the pickling was performed in the pickling bath containing a nitrate, good results, which were the Cu/Fe light-emitting intensity ratio in the decarburized steel sheet of 0.40 or less and the Cu/Fe light-emitting intensity ratio in the grain-oriented electrical steel sheet of 0.40 or less, were obtained.

In Samples No. 14 and No. 15, because of the C content being too large, the Cu/Fe light-emitting intensity ratio was large. In Samples No. 3, No. 16, No. 29, No. 42, No. 55, No. 68, and No. 81, because of the pickling condition being outside the range of the present invention, the Cu/Fe light-emitting intensity ratio was large. In Samples, No. 4, No. 17, No. 30, No. 43, No. 56, No. 69, and No. 82, because of the slab heating temperature being too low, a desired grain-oriented electrical steel sheet was not able to be obtained. In Samples No. 5, No. 18, No. 31, No. 44, No. 57, No. 70, and No. 83, because of the slab heating temperature being too high, the subsequent hot rolling was not able to be performed. In Samples No. 6, No. 19, No. 32, No. 45, No. 58, No. 71, and No. 84, because of the finishing temperature of the rough rolling being too high, a desired grain-oriented electrical steel sheet was not able to be obtained. In Samples No. 7, No. 20, No. 33, No. 46, No. 59, No. 72, and No. 85, because of the time period between start of the rough rolling and start of the finish rolling being too long, a desired grain-oriented electrical steel sheet was not able to be obtained. In Samples No. 8, No. 21, No. 34, No. 47, No. 60, No. 73, and No. 86, because of the start temperature of the finish rolling being too low, a desired grain-oriented electrical steel sheet was not able to be obtained. In Samples No. 9, No. 22, No. 35, No. 48, No. 61, No. 74, and No. 87, because of the finishing temperature of the finish rolling being too low, a desired grain-oriented electrical steel sheet was not able to be obtained. In Samples No. 10, No. 23, No. 36, No. 49, No. 62, No. 75, and No. 88, because of the finishing temperature of the finish rolling being too high, a desired grain-oriented electrical steel sheet was not able to be obtained. In Samples No. 11, No. 24, No. 37, No. 50, No. 63, No. 76, and No. 89, because of the time period between finish of the finish rolling and start of the cooling being too long, a desired grain-oriented electrical steel sheet was not able to be obtained. In Samples No. 12, No. 25, No. 38, No. 51, No. 64, No. 77, and No. 90, because of the cooling rate after the finish rolling being too slow, a desired grain-oriented electrical steel sheet was not able to be obtained. In Samples No. 13, No. 26, No. 39, No. 52, No. 65, No 78, and No. 91, because of the coiling temperature being too high, a desired grain-oriented electrical steel sheet was not able to be obtained.

The invention claimed is:

1. A grain-oriented electrical steel sheet, comprising:

a chemical composition comprising in mass %,

Si: 1.8% to 7.0%,

Cu: 0.03% to 0.60%, and the balance: Fe and impurities, wherein the impurities comprise C; and a primary coating film containing forsterite on a surface of the steel sheet, wherein a Cu/Fe light-emitting intensity ratio at an interface region between the primary coating film and the surface of the steel sheet is 0.30 or less, wherein the Cu/Fe light-emitting intensity ratio is evaluated by the average of (Cu light-emitting intensities/Fe light-emitting intensities), obtained by glow discharge optical emission spectrometry analysis, at respective measurement points in the interface region.

2. A manufacturing method of a grain-oriented electrical steel sheet, comprising:

a step of heating a slab in a temperature zone of 1300° C. to 1490° C.;

a step of obtaining a hot-rolled steel sheet by performing hot rolling of the slab;

a step of coiling the hot-rolled steel sheet in a temperature zone of 600° C. or less;

a step of performing hot-rolled sheet annealing of the hot-rolled steel sheet;

after the hot-rolled sheet annealing, a step of performing cold rolling and obtaining a cold-rolled steel sheet;

a step of performing decarburization annealing of the cold-rolled steel sheet; and after the decarburization annealing, a step of applying an annealing separating agent containing MgO and performing finish annealing, wherein the step of performing the hot rolling includes a step of performing rough rolling with a finishing temperature set to 1200° C. or less and a step of performing finish rolling with a start temperature set to 1000° C. or more and a finishing temperature set to 950° C. to 1100° C., in the hot rolling, the finish rolling is started within 300 seconds after start of the rough rolling, cooling at a cooling rate of 50° C./second or more is started within 10 seconds after finish of the finish rolling, pickling with a holding temperature set to 50° C. or more and a holding time period set to 30 seconds or more is performed in a pickling bath containing a nitric acid, a pickling inhibitor, and a surface active agent after the hot rolling and before finish of the cold rolling, and the slab includes a chemical composition comprising, in mass %, C: 0.03% to 0.15%, Si: 1.8% to 7.0%, Mn: 0.02% to 0.30%, S: 0.005% to 0.040%, acid-soluble Al: 0.010% to 0.065%, N: 0.0030% to 0.0150%, Cu: 0.03% to 0.60%, Sn: 0% to 0.5%, Ge, Se, Sb, Te, Pb, or Bi, or an arbitrary combination of these: 0.0005% to 0.030% in total, and the balance: Fe and impurities.

3. The manufacturing method of the grain-oriented electrical steel sheet according to claim 2, wherein the pickling bath further contains a nitrate.

4. A manufacturing method of a decarburized steel sheet for a grain-oriented electrical steel sheet, comprising:

a step of heating a slab in a temperature zone of 1300° C. to 1490° C.;

a step of obtaining a hot-rolled steel sheet by performing hot rolling of the slab;

a step of coiling the hot-rolled steel sheet in a temperature zone of 600° C. or less;

a step of performing hot-rolled sheet annealing of the hot-rolled steel sheet;

after the hot-rolled sheet annealing, a step of performing cold rolling and obtaining a cold-rolled steel sheet; and a step of performing decarburization annealing of the cold-rolled steel sheet; wherein the step of performing the hot rolling includes a step of performing rough rolling with a finishing temperature set to 1200° C. or less and a step of performing finish rolling with a start temperature set to 1000° C. or more and a finishing temperature set to 950° C. to 1100° C., in the hot rolling, the finish rolling is started within 300 seconds after start of the rough rolling, cooling at a cooling rate of 50° C./second or more is started within 10 seconds after finish of the finish rolling, pickling with a holding temperature set to 50° C. or more and a holding time period set to 30 seconds or more is performed in a pickling bath containing a nitric acid, a pickling inhibitor, and a surface active agent after the hot rolling and before finish of the cold rolling, and the slab includes a chemical composition comprising, in mass %

C: 0.03% to 0.15%,

Si: 1.8% to 7.0%,

Mn: 0.02% to 0.30%,

S: 0.005% to 0.040%, acid-soluble Al: 0.010% to 0.065%,

N: 0.0030% to 0.0150%,

Cu: 0.03% to 0.60%,

Sn: 0% to 0.5%,

Ge, Se, Sb, Te, Pb, or Bi, or an arbitrary combination of these: 0.0005% to 0.030% in total, and the balance: Fe and impurities.

5. The manufacturing method of the decarburized steel sheet for a grain-oriented electrical steel sheet according to claim 4, wherein the pickling bath further contains a nitrate.

* * * * *